United States Patent [19]

Banta et al.

[11] 3,988,961

[45] Nov. 2, 1976

[54] INTEGRATED ROCKET SHIPPING CONTAINER AND LAUNCHER

[75] Inventors: Charles C. Banta, Hamburg, N.J.; Carl R. Chambers, Huntsville, Ala.

[73] Assignee: The United States of America as represented by the Secretary of the Army, Washington, D.C.

[22] Filed: Aug. 8, 1975

[21] Appl. No.: 603,209

[52] U.S. Cl. ..... 89/1.807; 89/1.814; 89/1.816

[51] Int. Cl.[2] ..... F41F 3/04

[58] Field of Search ..... 89/1.816, 1.806, 1.812, 89/1.813, 1.8, 1.807, 1.817, 1.814

[56] References Cited

UNITED STATES PATENTS

| | | | |
|---|---|---|---|
| 3,088,373 | 5/1963 | Robert et al. | 89/1.814 |
| 3,182,553 | 5/1965 | Choate et al. | 89/1.817 |
| 3,315,565 | 4/1967 | Nash | 89/1.807 |
| 3,504,593 | 4/1970 | Ricks et al. | 89/1.816 X |
| 3,659,493 | 5/1972 | Wissner | 89/1.816 X |
| 3,710,678 | 1/1973 | Abelin et al. | 89/1.816 |
| 3,719,120 | 3/1973 | Elder et al. | 89/1.806 X |
| 3,754,497 | 8/1973 | Rusbach | 89/1.814 |
| 3,841,197 | 10/1974 | Morrisey | 89/1.816 |

*Primary Examiner*—David H. Brown
*Attorney, Agent, or Firm*—Nathan Edelberg; A. Victor Erkkila; Max Yarmovsky

[57] ABSTRACT

A combined rocket container launcher utilizes a housing which is capable of withstanding normal shipping forces and which can be easily installed on a carrier weapon without undergoing an unpack-load launcher procedure. The integrated container-launcher permits a plurality of rockets to be safely transported to the site of use and rapidly installed and fired as a unit with only a minimum number of mechanical operations and electrical connections.

5 Claims, 8 Drawing Figures

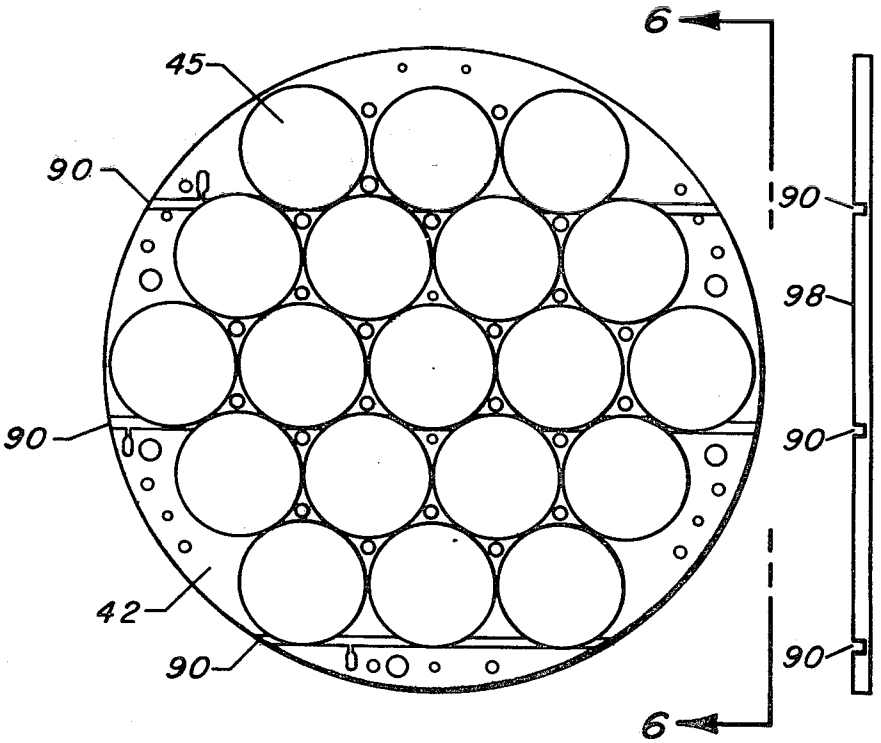
FIG. 6
FIG. 5
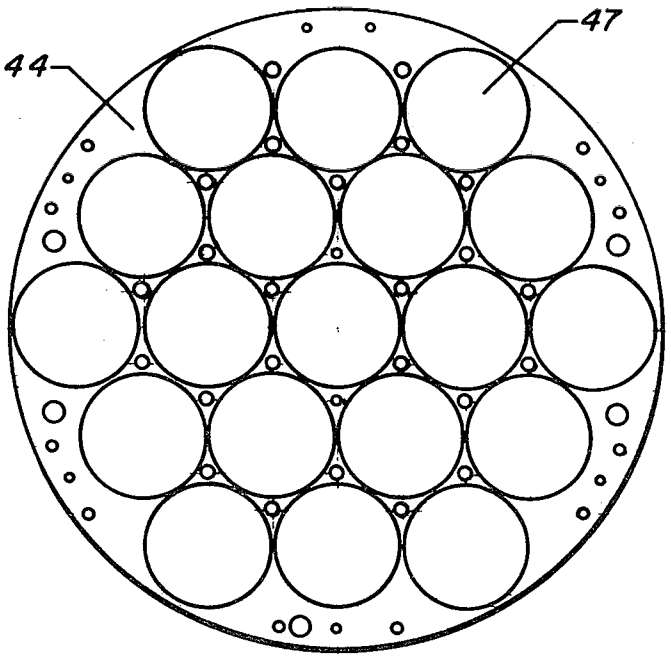
FIG. 4

INTEGRATED ROCKET SHIPPING CONTAINER AND LAUNCHER

GOVERNMENT INTEREST

The invention described herein was made in the course of a contract with the Government and may be manufactured, used and licensed by or for the Government for governmental purposes without the payment to us of any royalty thereon.

BACKGROUND OF THE INVENTION

Various means have been used in the prior art to transport and load rockets into a carrier weapon such as a helicopter or into a fixed wing aircraft. One of the problems with these prior art devices was that in order to reload a launching vehicle, a rearm crew had in most instances, to individually take each rocket out of its shipping container and load it into a launcher. This procedure was often time consuming and expensive and under battlefield conditions could be hazardous to personnel when the carrier weapon was rearmed in a forward combat area. Another problem with prior art launching devices was their excessive weight which frequently limited the aircraft payload carrying capability. It was not uncommon for a launcher system without rockets therein to weigh approximately 300 to 400 pounds. The flight weight for a 19 tube launcher of the present design is approximately 80 pounds. In addition, the prior art devices were generally more costly than the present invention because they often required separate packaging materials for shipment of the rockets which were not reuseable.

SUMMARY OF THE INVENTION

The present invention relates to a munition having an integrated shipping container-launcher for holding a plurality of rockets therein. The container-launcher comprises a metal drum housing which holds a plurality of rocket launching tubes therein. After a plurality of rockets are loaded in the container the container-launcher can be shipped as a unit and directly attached to the carrier weapons system without unloading the container and reloading the launcher of the carrier. The housing or container utilizes a modified commercial type steel drum having a cover and quick release closing device at each end of the drum. A plurality of tubes are arranged in the drum or container with the void areas therebetween being filled by a material such as polyurethane foam or other plastic type foam. A detent bar having a U-shaped cross-sectional area is placed in a motor-fin groove of each rocket and locates each rocket at the entrance of each launch tube. The support ring section of the detent bar holds the rocket in the container during shipment and while a rocket is being fired from the launcher assembly. When the rocket is fired the detent tab will release the rocket at a thrust of 400 to 475 pounds. A polystyrene or polyethylene foam support helps to contain the fin areas of the rockets and provides cushion protection during shipping and transportation. A contact wire assembly electrically connects the rockets to an igniting signal from a power source.

An object of the present invention is to provide an inexpensive integrated rocket shipping container and launcher.

Another object of the present invention is to provide an integrated rocket shipping container and launcher which can be easily installed on a carrier weapon.

Another object of the present invention is to provide an integrated rocket shipping container and launcher which permits a plurality of rockets to be safely transported to the site of use, rapidly installed, and fired.

Another object of the present invention is to provide an integrated rocket shipping container and launcher which permits rockets to be installed on a carrier weapon and fired therefrom with only a minimum number of mechanical operations and electrical connections.

A further object of the present invention is to provide an integrated rocket shipping container and launcher which has a weight of approximately 80 pounds when unloaded.

For a better understanding of the present invention, together with other and further objects thereof, reference is made to the following descriptions taken in connection with the accompanying drawings.

BRIEF DESCRIPTION OF THE DRAWINGS

FIG. 4 is a view taken along line 4—4 of FIG. 1 showing the aft bulkhead face plate.

FIG. 5 is a view taken along line 5—5 of FIG. 1 showing the aft bulkhead.

FIG. 6 is a side view of the aft bulkhead taken along line 6—6 of FIG. 5.

Throughout the following description like reference numerals are used to denote like parts of the drawings.

DESCRIPTION OF THE PREFERRED EMBODIMENTS

Figure 1:
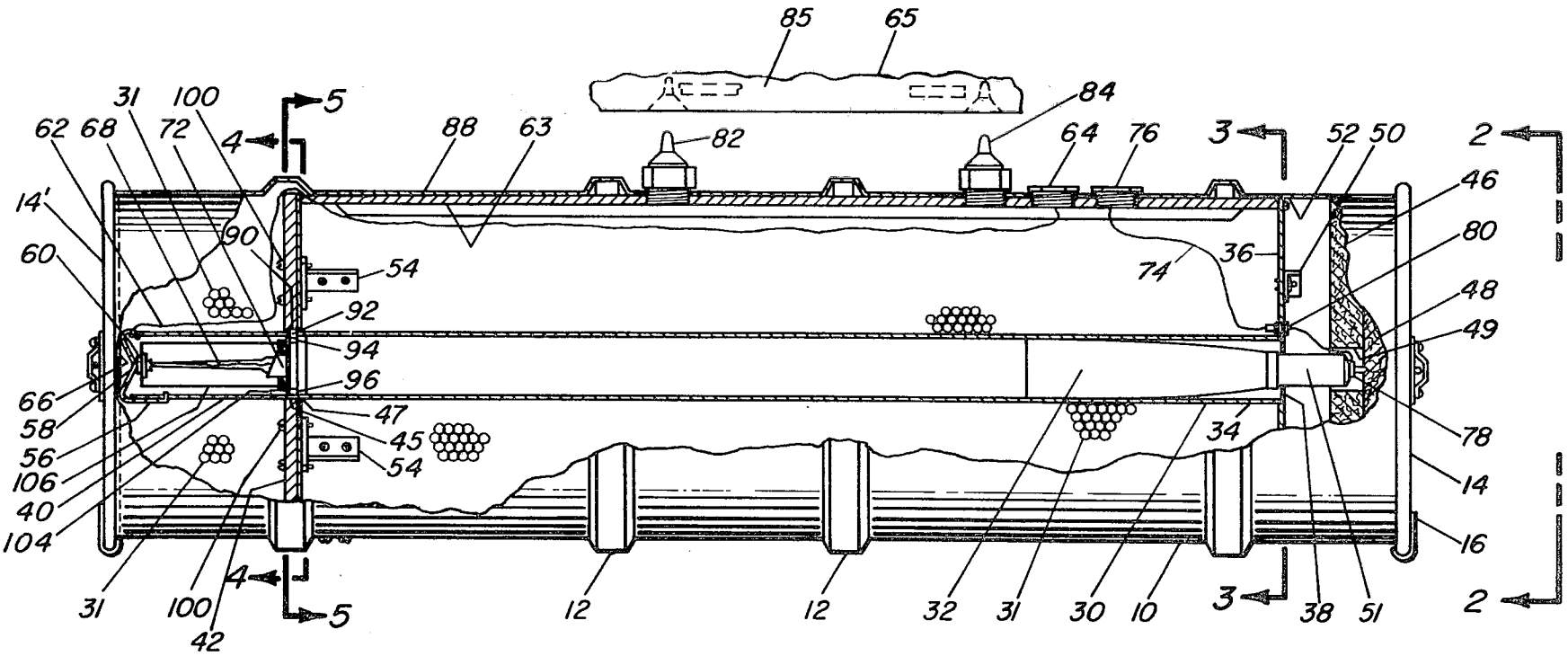
FIG. 1 is a diametral longitudinal cross-sectional view of the integrated rocket shipping container and launcher with a rocket shown in its normal unfired position.
Figure 3:
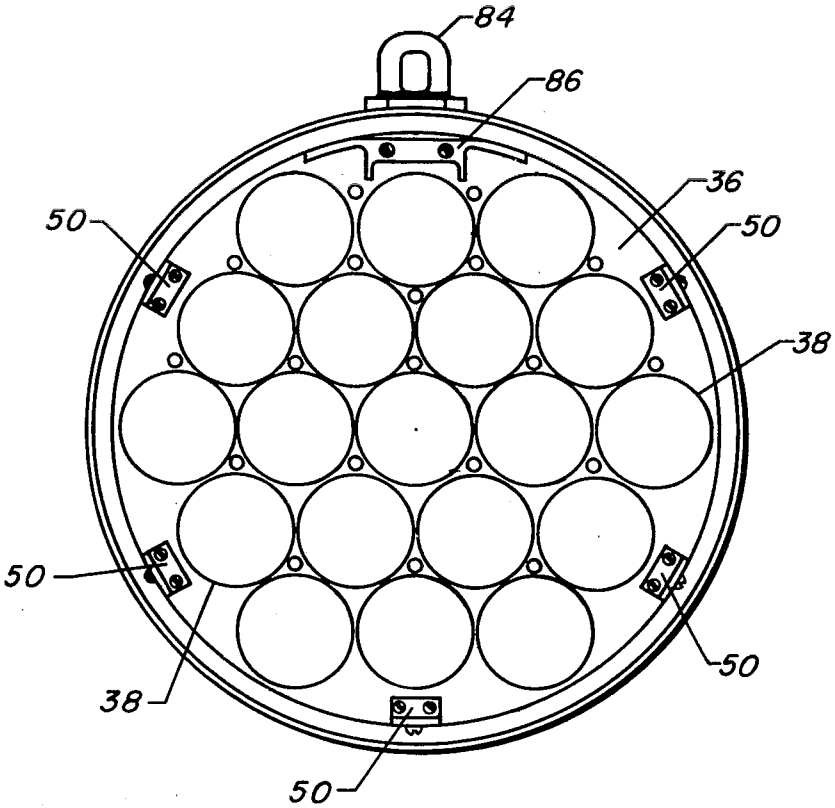
FIG. 3 is a view taken along line 3—3 of FIG. 1 showing the forward end of the container-launcher looking toward the rear.
Figure 2:
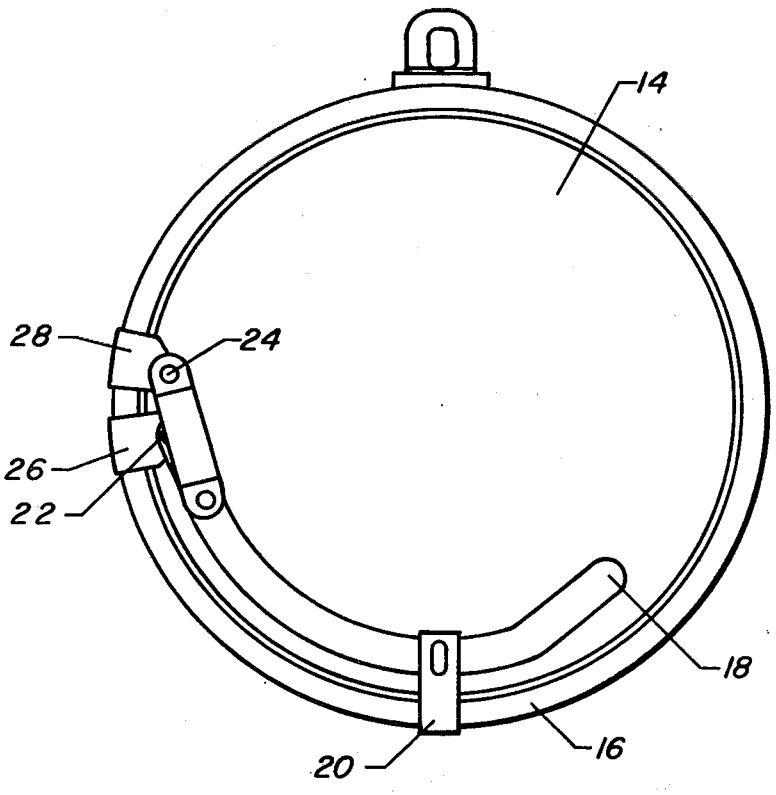
FIG. 2 is a view taken along line 2—2 of FIG. 1, showing the container-launcher forward cover and latch type lever closure.

Referring now to FIGS. 1 and 2 a hollow cylindrical drum 10 forms the housing of the shipping container-launcher. The drum 10 has a plurlaity of circumferentially disposed integral rolling hoops 12 thereon. The hoops 12 raise the drum 12 above the ground for easy opening of forward and aft drum covers 14 and 14' respectively. The locking ring 16 is easily removed from cover 14 and 14' when handle 18 is unlatched from handle clasp 20 and handle 18 is rotated in a counter-clockwise direction causing handle pivot points 22 and 24 to move away from each other so that the ring ends 26 and 28 of ring 16 are spread apart. Referring now to FIGS. 1–5 a plurality of rocket launching tubes 30, containing rockets 32 therein, are supported on their forward ends 34 by a disc shaped metal forward bulkhead member 36, made of such material as aluminum, in counter bored holes 38 and on their rear ends 40 by a disc shaped aft metal bulkhead member 42 and aft metal bulkhead face plate 44. The forward bulkhead 36 secures the forward tube ends 34 in place and covers the face of the tube 30 and retains the plyurethane foam 31, which fills the voids between the tubes 30 and the interior walls of drum 10, against flame produced by the exiting rockets 32. The polyurethane foam 31 provides internal support for launching tubes 30. The aft bulkhead 42 has a plurality of tube holes 45 therethrough which are in axial alignment with aft face plate holes 47 and forward bulkhead holes 38. Positioned intermediate the forward bulkhead 36 and the forward covers 14 are first and second circularly shaped foam cushioning pads 46, and 48 respectively made of such material as polyurethane; each being cemented to each other and the latter pad 48 being cemented to the interior wall of cover 14. First pad 46 has a plurality of rocket nose holes 49 therein to allow for passage and support of rocket nose ends 51. A plurality of forward L-shaped bulkhead brackets 50 are screwedly fixed to the interior wall 52 of drum 10 and the peripheral edge of the bulkhead 36 securing the bulkhead 36 to the drum 10. In a similar manner aft bulkhead brackets 54 fixedly hold aft bulkhead 42 and aft face plate 44 to the interior wall 52 of drum 10. A plurality of firing spring wire clips 56 are secured to the aft ends 40 of each launching tube 30. The inwardly protruding section 58 of clips 56 make electrical contact to each rocket contact button 60. A first electrical conductor 62 electrically couples each contact clip 56 to a first multi-pin connector 64, which is threadedly fixed to hardback member 63. A power source is electrically connected to connector 64 when the container-launcher is joined with a weapon carrier 65. When the aft cover 14' is on the body 10, as shown in FIG. 1, the interior metal wall surface 66 of cover 14' contacts the firing clips 56 and electrically grounds the complete unit during shipment and storage. The short across contact button 60, when the cover 14' is in its closed position, prevents a premature malfunctioning signal from reaching the rocket initiating circuit through squib conductor 68 which enters into the rear end of rocket nozzle 72. A second electrical conductor 74, which has one end connected to a second multi-pin connector 76, is threadedly fixed to hardback member 63. The other end of conductor 74 is connected to the rocket fuze 78 through a feed-through connector 80. Conductor 74 is used to arm the rocket fuze 78 during the rocket launch. A pair of externally threaded lug adapters 82 and 84 are screwedly attached to hardback member 63 so that drum wall 88 is held therebetween. The hardback member 63 gives structural strength to the relatively thin drum wall 88 and allows the container-launcher to be readily suspended from weapon carrier 65 by the lug adapter 82 and 84 by fitting into locking mechanism 85 of carrier 65.

Figure 7:
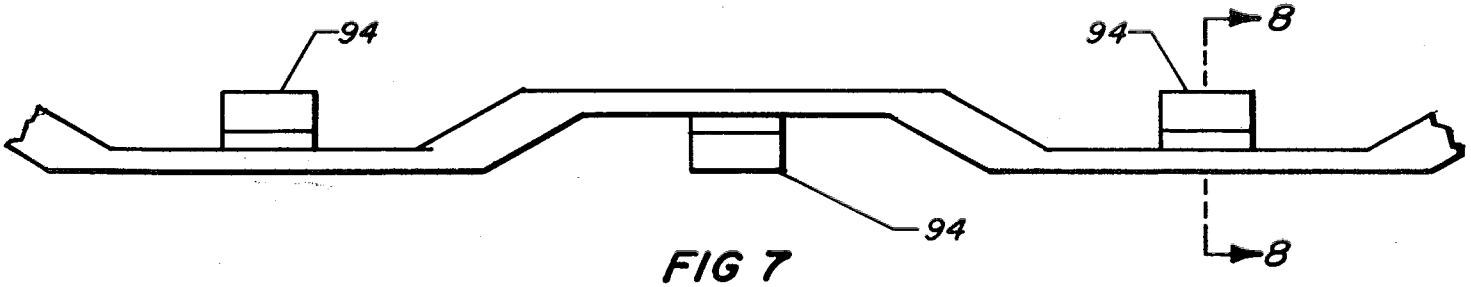
FIG. 7 is an elevational view of a detent bar.
Figure 8:
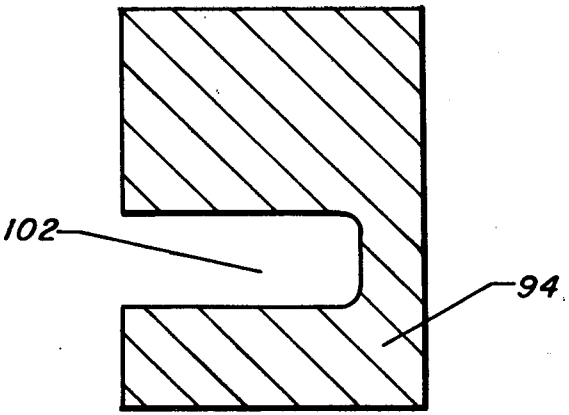
FIG. 8 is a cross-sectional view taken along line 8—8 of FIG. 7.

Referring now to FIGS. 1 and 5-8 the aft bulkhead 42 has a plurality of transverse detent grooves 90 which hold formed detent bars 92 therein as shown in FIGS. 7 and 8. The detent bars 92 have a plurality of "U" shaped integral tabs 94 thereon which interlock with each rocket as the detent bar 92 extends transversely from one side of the container to the other. Each tab 94 on the detent bar 92 rests within a rocket annular detent groove 96. The detent tabs 94 secure the rockets 32 from axial movement in launching tubes 30 prior to rocket launch. The aft bulkhead face plate 44 is secured to the grooved side 98 of aft bulkhead 42 with bolts 100, which are fixedly attached to aft bulkhead L brackets 54. After the bulkhead detent grooves 90 are completely enclosed on four sides the detent bars 92 cannot move. Upon rocket 32 ignition, the detent tabs 94 are designed to shear at approximately 400 to 475 pounds thrust thus allowing the rockets 32 to exit from tubes 30. By modification of the size of milled notch 102 the thrust requirement can be increased or decreased as required.

An anti-rotation stop member 104 is secured within the aft ends 40 of each tube 30 so that it is intermediate a pair of the rocket nozzle fins 106. Stop 104 prevents rockets 32 from rotating within launching tubes 30 and from causing possible damage to the rocket 32, fuze umbilical electrical conductor 74, or to the initiating electrical conductor 62. Stop 104 is fixedly held in a longitudinal slot in the launching tube rear end 40.

In operation, upon arrival at an arming or rearming site, the drum covers 14 and 14' are removed from the drum 10. The container-launcher, shown in FIG. 1, is attached to the carrier 65 by mechanical connection to lug adapters 82 and 84 and by plugging the aircrafts electrical power source into the first and second multi-pair connectors 64 and 76 respectively. The charging of fuzes 78 and the initiation of the launching of the rockets 32 are controlled by the aircraft pilot when he causes a current to flow in conductors 74 and 62 respectively. The firing clips 56 transmit the electrical signal to the rocket contact buttons 60 which in turn transmit the energy to a squib through conductor 68 which then ignites the motors of rockets 32. When the forward thrust of the ignited rocket motor thrust reaches approximately 400 to 475 pounds force, the detent tabs 94 shear off thereby permitting the rockets 32 to exit from tubes 30 and proceed toward their intended target.

The foregoing disclosure and drawings are merely illustrative of the principles of this invention and are not to be interpreted in a limiting sense. We wish it to be understood that we do not desire to be limited to the exact details of construction shown and described for obvious modification will occur to a person skilled in the art.

Having thus fully described the invention, what is claimed as new and desired to be secured by Letters Patent of the United States is:

1. A munition for use on a weapon carrier which comprises:

a plurality of rockets each having aft ends and nose ends;

an ignition squib operatively disposed in each aft end of said plurality of rockets;

a fuze operatively positioned in each nose end of said plurality of rockets;

a container-launcher means for safely holding said plurality of rockets therein during transportation of said plurality of rockets and said container-launcher means to said weapons carrier, and for providing initiation, arming and guidance to said plurality of rockets during launching which includes;

a hollow tubularly shaped housing having a forward end and an aft end;

releasable cover means for protecting said plurality of rockets during transportation and for allowing easy removal of said cover means from the forward and aft ends of said housing prior to launching of said rockets from said counter-launcher means;

means for attaching said housing to said weapons carrier which includes;

a hardback member extending longitudinally along an interior wall of said housing; and a plurality of externally threaded lugs screwedly fixed to said hardback member so that the wall of said housing is fixedly held therebetween, wherein said lugs readily mate with and lock into said weapons carrier;

means for electrically arming and initiating said plurality of rockets;

a first multi-pin electrical connector threadedly fixed to said hardback member;

a second multi-pin electrical connector threadedly fixed to said hardback member;

means for electrically connecting said first multi-pin connector to said ignition squibs and for electrically connecting said second multi-pin connector to said fuzes located in the nose ends of said plurality of rockets;

a plurality of rocket launching tubes longitudinally disposed in said housing;

means for detenting said plurality of rockets within said launching tubes;

baffle means for uniformly spacing said launching tubes within said housing and for shielding said launching tubes from the blast effect of said plurality of rockets when they exit from said launching tubes; and means for compliantly holding said launching tubes within said housing to protect said plurality of rockets from the forces of shock and vibration during the transportation of said plurality of rockets by said weapons carrier.

2. A munition as recited in claim 1 wherein said baffle means comprises:

a forward disc shaped bulkhead member having a plurality of counterbored holes therein which have located therein the forward ends of said plurality of rocket launching tubes, said forward bulkhead member being transversely positioned in the forward end of said housing and fixedly attached thereto;

an aft disc shaped bulkhead member having a plurality of launching tube holes in axial alignment with the counterbored holes of said forward bulkhead member, said aft bulkhead member having located therein the aft end of said plurality of rocket launching tubes, said aft bulkhead member having a plurality of transversely positioned detent grooves located on one side of said aft bulkhead member, said aft bulkhead member being transversely positioned in the aft end of said housing and fixedly attached thereto; and an aft bulkhead face plate having a plurality of holes therein in axial alignment with said forward and aft bulkhead members, said face plate covering said aft bulkhead detent grooves and said means for detenting located therein.

3. A munition as recited in claim 1 wherein said means for compliantly holding said launching tubes comprises:

a first circularly shaped cushioning pad having a plurality of nose end holes therein for supporting the nose ends of said rockets, wherein said first pad is made of such material as polyurethane foam;

a second circularly shaped cushioning pad, made of polyurethane foam, being cemented on one side to said fist cushioning pad and on its other side to the interior wall of the covering means protecting said housing forward end; and polyurethane foam material disposed intermediate said launching tubes, and intermediate said launching tubes and the interior wall of said housing.

4. A munition as recited in claim 1 wherein said means for detenting comprises:

an anti-rotation stop member fixedly secured in the aft ends of said rockets and positioned intermediate a pair of the nozzle fins of said rockets, said stop member preventing said rockets from rotating within said launching tubes; and a plurality of formed detent bars having a plurality of "U" shaped integral tabs thereon operatively positioned within said annular rocket detent grooves; wherein upon rocket ignition said detent tabs are designed to shear off, thereby allowing said rockets to be released from said detent bars and to exit from said launching tubes.

5. An integrated rocket shipping container-launcher for use on a weapon carrier for launching a plurality of rockets therefrom which comprises:

a hollow tubular housing having a forward end and an aft end;

releasable cover means for protecting and closing said forward and aft ends of said housing;

lug means fixedly attached to said housing for making mechanical connections between said container-launcher and said weapons carrier;

electrical connector means for providing a plurality of electrical connections between said weapons carrier and said container-launcher;

launching means for safely holding said plurality of transportation and for guiding said plurality of rockets during the launching of said plurality of rockets from said weapons carrier;

means for detenting said plurality of rockets within said launching means during transportation and while said plurality of rockets are being ignited and developing substantial thrust which includes;

an aft bulkhead member, transversely fixedly positioned in said housing, having a plurality of transversely positioned detent grooves therein;

a plurality of detent bars having a plurality of "U" shaped integral tabs operatively disposed thereon, said plurality of detent bars being positioned in said plurality of detent grooves of said bulkhead member, said plurality of "U" shaped integral tabs interlocking each of said plurality of rockets and preventing said plurality of rockets from having axial movement in said launching means prior to launch, said plurality of detent tabs being designed to shear at an approximate 400 to 475 pound thrust level, and to release said plurality of rockets from said launching means when said 400 to 475 pound thrust level has been obtained;

baffle means, fixedly positioned in said housing, for uniformly spacing said launching means within said housing and for protecting said launching means from the blast effect of said plurality of rockets when said plurality of rockets exit from said container-launcher; and compliant foam means, fixedly attached to said cover means, for providing vibration and shock protection to said plurality of rockets being transported in said containter-launcher.

* * * * *